United States Patent [19]

Merrick

[11] Patent Number: 4,932,292

[45] Date of Patent: Jun. 12, 1990

[54] SUCKER ROD TOOL

[76] Inventor: Jake Merrick, P.O. Box 8420, Levelland, Tex. 79338

[21] Appl. No.: 259,131

[22] Filed: Oct. 18, 1988

[51] Int. Cl.[5] ..... B25B 13/18

[52] U.S. Cl. ..... 81/57.18; 81/128

[58] Field of Search ..... 279/56, 71, 114; 81/57.18, 57.21, 57.32, 128, 463

[56] References Cited

U.S. PATENT DOCUMENTS

| | | | |
|---|---|---|---|
| 2,580,247 | 12/1951 | Secundi et al. | 81/128 |
| 2,962,291 | 11/1960 | Szlachetka | 279/114 |
| 3,371,562 | 3/1968 | Kelley | 81/57.18 |
| 4,713,990 | 12/1987 | Poling | 81/57.33 X |

OTHER PUBLICATIONS

Florida Pneumatic Manufacturing Corporation, Air Tools, Catalog, p. 25, 5/1985.

*Primary Examiner*—D. S. Meislin

[57] ABSTRACT

A double ended socket has a tapered spline bore in each end thereof. A square hole at a midpoint internal flange provides means for attaching the socket to an impact wrench for removing a thread protector from a pin of a sucker rod. A gripping socket has three floating jaws within a housing to engage coupling of a sucker rod. With an impact wrench, the gripping socket readily removes a coupling from a sucker rod pin. The two tools are used to inspect, clean, and lubricate sucker rods, and to maintain the lubricated pins clean until the rods are run in a well.

4 Claims, 4 Drawing Sheets

SUCKER ROD TOOL

RIGHTS TO INVENTIONS UNDER FEDERAL RESEARCH

There was no federally sponsored research and development concerning this invention.

BACKGROUND OF THE INVENTION (1) Field of the Invention

This invention relates to a tool for working on sucker rods, and more particularly to a gripping socket for an impact wrench to remove couplings from sucker rods and also a socket to attach and remove protectors for sucker rod pins. An oil field worker who works on sucker rods is one having ordinary skill in this art.

(2) Description of the Related Art

Sucker rods for oil wells are threaded on both ends, or stated in common terminology, they have pins on both ends. The pin includes a radial shoulder or flange which is a friction surface upon which the couplings are torqued. Inboard of the flange having the shoulder, are wrench flats, i.e., the rod at that point has a square cross section. Normally a nonadjustable wrench which has one open side is used to grasp the wrench flat.

The sucker rods are connected by couplings. The coupling is a short threaded tube which is threaded onto the pins. In many cases, a sucker rod string will be over 5,000 feet in length, and normally, they are made of steel. Therefore, it may be seen that there is considerable weight upon the sucker rod. In addition to weight, there is stress reversal in use, reversing the stress with every stroke of the pump. For this reason, the American Petroleum Institute (API) has adopted specifications and standards for the sucker rods, couplings, threads, and also, the torque of the coupling attached to the pin. All of this is critical so that the couplings will not break or loosen during use.

Often the rod string is subject to severe corrosion. Often the couplings will have special coatings on them to prevent corrosion. It is necessary that this coating not be ruptured or badly indented because the resulting strain upon the coupling will enhance corrosion. After use, the couplings often bond to the rods upon which they are attached.

The sucker rod string connects a pump jack upon the surface of the earth to a pump far beneath the surface. Since the pump is subject to corrosion, erosion, and wear, it is necessary to pull the pump for maintenance and repair. Pulling the pump entails pulling the sucker rod from the well. Normally sucker rod joints are 25' in length. Normally the sucker rod will be pulled from the well in stands; a stand being three sucker rods. With the 25' sucker rods in a 5,000' well, it is seen that there would be 200 sucker rods within the well. Any time a well is pulled, it is not unusual for 10%-20% of the couplings to be replaced because of wear or corrosion damage. In some instances, all of the couplings will be replaced. In many instances, all of the couplings will be removed from the rods and the pins inspected for corrosion and other damage.

Often, the crew either pulling the rods from the well or running the rods back in the well will be furnished with power tongs. Power tongs in the tool which fits upon the wrench flats to torque the sucker rods when they are being run into the well or which break the joint of the sucker rod to the coupling when they are coming out of the well. Except for inspection or replacement, the coupling will be left upon one of the pins of the sucker rod.

Obviously, for a complete inspection or replacement, it is necessary that a coupling be removed from the sucker rod after the joint of sucker rod has been separated from the string.

Before this invention, it was commercial practice to remove the coupling from the sucker rod using hand tools.

Often for complete inspection and renovation of the pins of a sucker rod, the sucker rod is transported to a shop. After the pins have been cleaned, inspected, and lubricated, a thread protector is placed over the thread. The thread protector is normally a synthetic material, elastomer, which is normally attached to the pins by driving it on with a hammer. The exterior of the protector is fustroconic with 16 splines thereon.

With protectors driven on by hammer, some are very securely attached. However, some protectors are not securely attached and will drop off in transportation and handling. Also, the protectors that are securely attached are difficult to remove and are often removed by using a screw driver as a chisel to pry them off. The thread protectors may be screwed upon the pins; however, with the present shape of the protectors and the tools available, this is impractical to either screw them on or screw them off.

SUMMARY OF THE INVENTION (1) Progressive Contribution to the Art

This invention discloses a method and means for quickly and easily removing the couplings and for quickly, easily, and securely attaching and removing the thread protectors.

The means used to attach and remove the protector is a special socket having the interior of the socket mating with the fustroconic splined exterior of the protector. This socket is placed upon a common commercially available pneumatic impact wrench. Having a socket that will fit the conic protectors, it is a simple matter to attach them by screwing them on at the shop With such attachment the protectors are connected more securely at the shop. Also, the seal is made against the flange so that the lubricant upon the threads is protected from contamination, particularly with grit. Also, they can be readily removed using one of the sockets according to this invention in the field at the well site. Since they can be removed quickly and easily, they may be left in place until a minute or so before they are actually connected to the couplings, thereby maintaining them in better condition.

Breaking the couplings from the rods presents a difficult problem. First, it will be recognized that the couplings are tightened so that the metal is prestressed to withstand the stress reversals in use. Second, the corrosion and well conditions tend to bond the couplings to the rods. Third, it is desirable not to scar the corrosion resistant covering of the coupling. Forth, the coupling has a cylindrical hard surface.

If the coupling were hexagonal, it would be possible to use a hexagonal socket with an impact wrench to break the coupling loose from the rod. Such would be recognized by workers in the art. However, before this invention, a gripping socket for an impact wrench that would grip the hard circular cylindrical surface of the coupling was not commercially available. This invention provides such a socket. The gripping socket has a cup shaped housing, one end of which will fit the anvil of an impact wrench, and the other end of the cup has internal cam surfaces in it. Three jaws slidingly mate with the cam surface and are held in place with a positioning ring. The positioning ring by use of slots and lugs hold the jaws in proper orientation. The positioning ring and the jaws may rotate so the jaws slide along the cam surfaces. The positioning ring is held in place by a retaining ring which permits rotation of the positioning ring within the housing which has the cam surfaces.

Therefore, it may be seen that with few parts it is very ruggedly constructed so that the socket may withstand the hammering which is necessary for proper operation of the impact wrench. The face of the jaws have cross checked faces which provide suitable clamping or gripping action upon the coupling but will not gouge or scar the coupling or the corrosion coating or plating thereon.

One of the advantages of the tool is that it increases the ability to remove the coupling from the rod so that the time to remove it may measured in seconds rather than minutes. With it being much easier and quicker to remove the couplings and rods, it makes it possible to inspect the pins and couplings each time the sucker rod string is pulled from the well. With better inspection and maintenance, the life can be greatly extended; and therefore, normally the only time it is necessary to work on the well is for maintenance of the pump and not because of the breakdown of the sucker rod.

(2) Objects of this Invention

An object of this invention is to quickly remove and inspect sucker rods from an oil well and replace the inspected rods.

Another object of this invention is to provide a gripping socket for round cylindrical objects for an impact wrench.

Another object of this invention is to quickly and easily remove the coupling from sucker rod without damaging the couplings.

A further object of this invention is to quickly, easily, and securely apply and remove protectors to the pins of sucker rods without damage to the pins.

Still further objects are to achieve the above with devices that are sturdy, rugged, compact, durable, lightweight, simple, safe, efficient, versatile, ecologically compatible, energy conserving, and reliable, yet inexpensive and easy to manufacture, connect, operate and maintain.

Other objects are to achieve the above with a method that is rapid, versatile, ecologically compatible, energy conserving, efficient, and inexpensive, and does not require highly skilled people to connect, operate, and maintain.

The specific nature of the invention, as well as other objects, uses, and advantages thereof, will clearly appear from the following description and from the accompanying drawing, the different views of which are not scale drawings.

Figure 1:
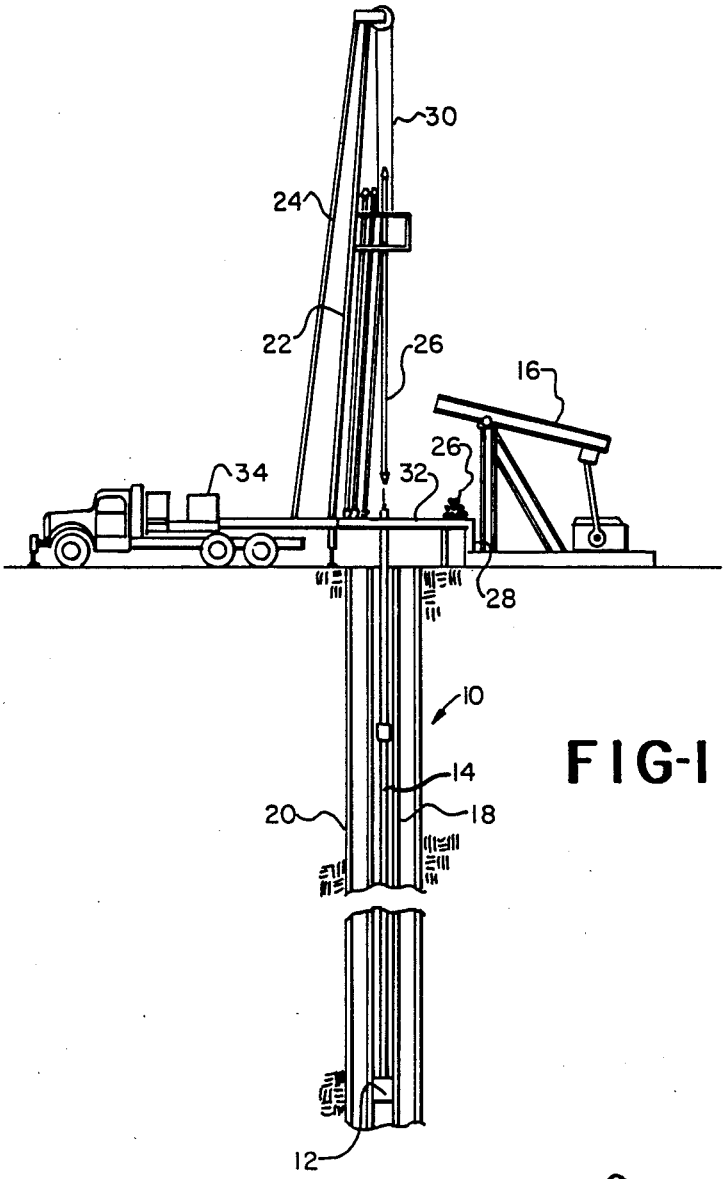
FIG. 1 is a schematic representation of an oil well with the rods being pulled therefrom.
Figure 2:
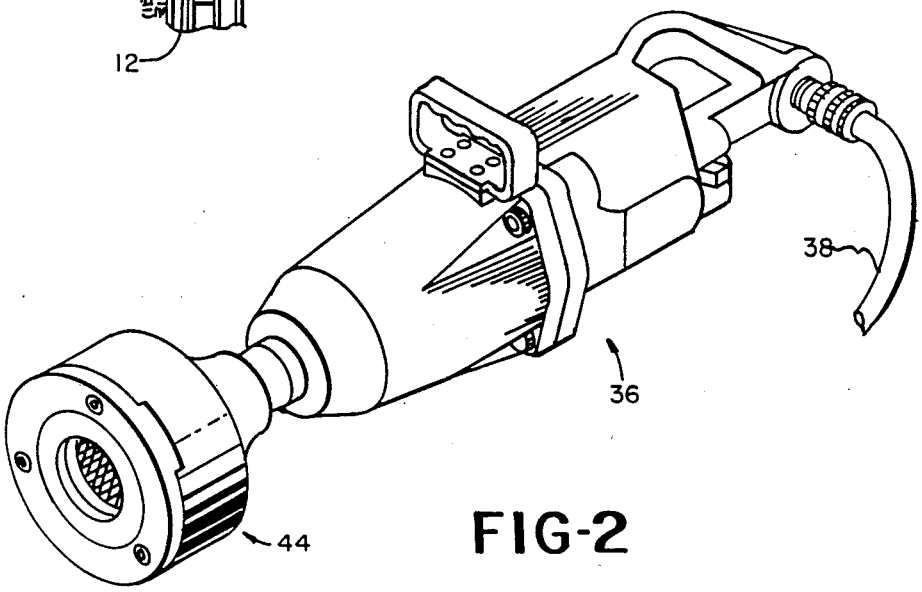
FIG. 2 is a perspective view of an impact wrench with a gripping socket according to this invention attached thereto.

As an aid to correlating the terms of the claims to the exemplary drawing, the following catalog of elements and steps is provided:

10 oil well
12 pump
14 string
16 pump jack
18 tubing
20 casing
22 stands
24 derrick
26 joint
28 rack
30 elevator
32 floor
34 source of air
36 impact wrench
38 air hose
40 anvil
42 square bit
44 gripping socket
46 neck
48 hole
50 housing
52 cam cavity
54 housing cams
56 flat face
58 jaws
60 jaw bottom
62 jaw top
64 lug
66 gripping face
68 coupling
70 cam face
72 positioning ring
74 circular cavity
76 slots
78 lower surface
80 compression spring
82 retaining ring
84 keys
86 bore
88 bolts
90 grooves
91 protector
92 double socket

94 large bore
96 flange
98 square hole
100 small bore
102 slot
Axis "A"

DESCRIPTION OF THE PREFERRED EMBODIMENT

Referring to the drawing, there may be seen a schematic representation of an oil well 10 with the sucker rods being pulled.

It will be understood that the oil well includes the pump 12 deep within the ground. The pump will be actuated by a string of sucker rods 14 extending from pump jack 16 upon the surface of the earth to the pump 12. Oil will be pumped through tubing 18 which is within casing 20 of the oil well. When pulling the string of sucker rods, the sucker rods may be broken into stands 22 of rod and stacked within derrick 24 of the pulling rig. Otherwise, the string 14 may be broken into individual joints 26 and laid upon rack 28 adjacent to the derrick of the pulling rig.

As shown in the drawings, a joint of rod 26 is suspended by elevator 30 of the pulling rig. At the floor 32 of the rig, it will be understood that there will be a working space where tools such as slips may be used to hold and suspend a partial string of rods which are still in the ground, to prevent them from falling into the well. Also, there will be power tongs (not shown) for either connecting or disconnecting a joint 26 above the ground from a partial string 14 within the well.

Also available at the pulling rig will be a source 34 of compressed air such as an air compressor with a storage tank. Well known equipment will also include an impact wrench 36 connected to the source of air by air hose 38. The preferred form of the impact wrench for this invention is one having an extended anvil 40. The anvil has a square insert or bit 42 thereon.

Those having skill in the oil field will understand that the equipment shown or described to this point is well known to those having ordinary skill in the art. For conciseness of the description and clarity of the drawings, such tools as the power tongs and the slips to hold the partial string of the rods at the floor have not been shown. Also, the procedures for removing the pump jack head and similar procedures have not been described since they are all well known to persons skilled in this art.

According to this invention, gripping socket 44 is cup shaped, having an axis "A". Neck 64 of the socket has square hole 48 which mates with the square bit 42 of the impact wrench 36. Both the square hole 48 and the square bit 42 are non round. The body of the gripping socket forms cylindrical housing 50. I prefer the housing to be cylindrical and smooth with soft edges so that there is little possibility of catching pieces of clothing, gloves or the like and injuring the workman using the equipment. All sharp corners, projecting bolt heads and the like are avoided.

Cylindrical depression or cam cavity 52 is within the housing 50. It will be understood that when it is stated the cavity is cylindrical, it means that all of the walls thereof are parallel to the axis "A". "Cylindrical" does not mean that it is a circular cavity. It is preferred that the outside of the housing 50 be a circular cylinder, but it is necessary that the cavity 52 not be. Within the inside of the cavity, there are three cam surfaces or housing cams 54. The bottom of the cavity will be a flat supporting face 56.

Three identically shaped jaws 58 have flat bottoms 60 which are slidingly supported by the flat face 56. Stated otherwise, the jaws float on the flat face 56.

Also, each of the jaws will have a flat top 62 except for lug 64, projecting above the flat surface, as will be described later in more detail.

Figure 3:
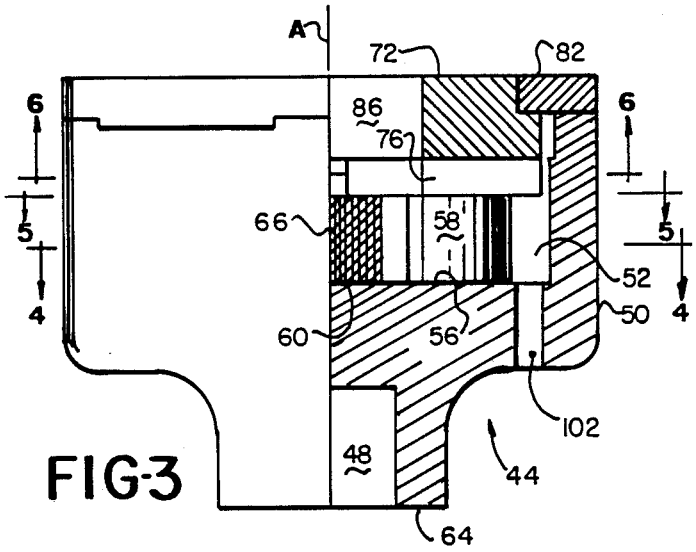
FIG. 3 is an axial half sectional view of a gripping socket according to this invention taken substantially on lines 3—3 of FIG. 4.
Figure 4:
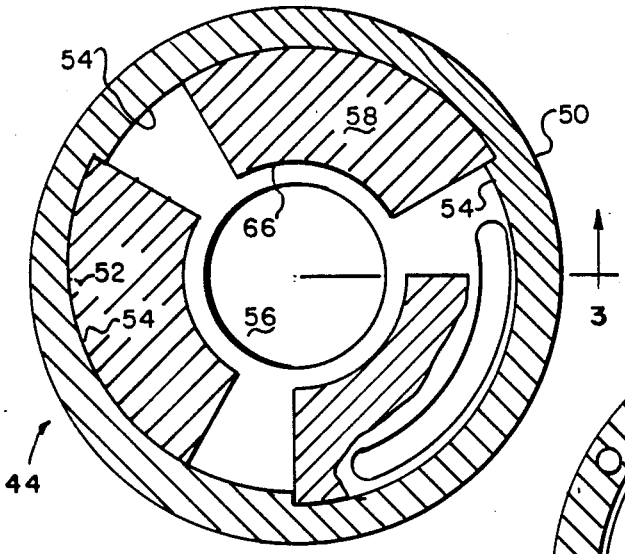
FIG. 4 is a cross sectional view thereof taken substantially on lines 4—4 of FIG. 3.
Figure 6:
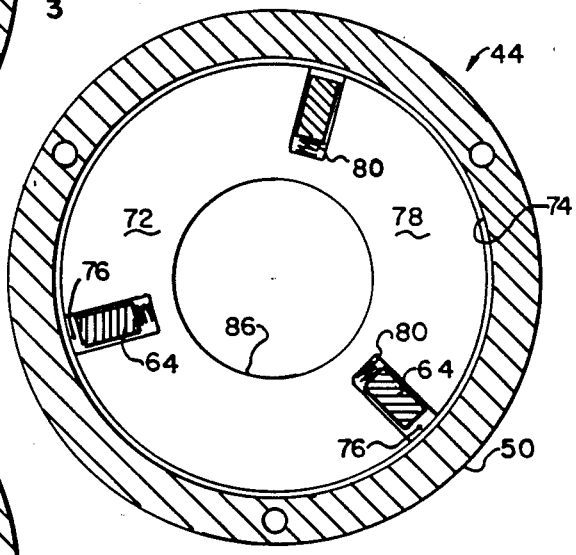
FIG. 6 is a cross sectional view thereof taken substantially on lines 6—6 of FIG. 3.
Figure 5:
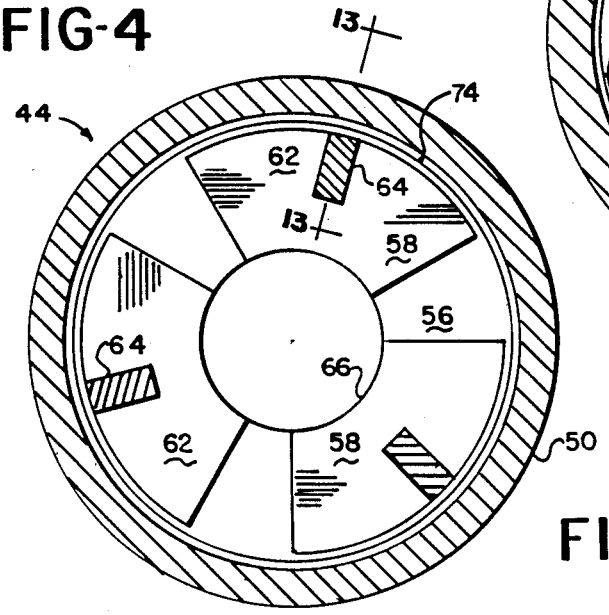
FIG. 5 is a cross sectional view thereof taken substantially on lines 5—5 of FIG. 3.
Figure 12:
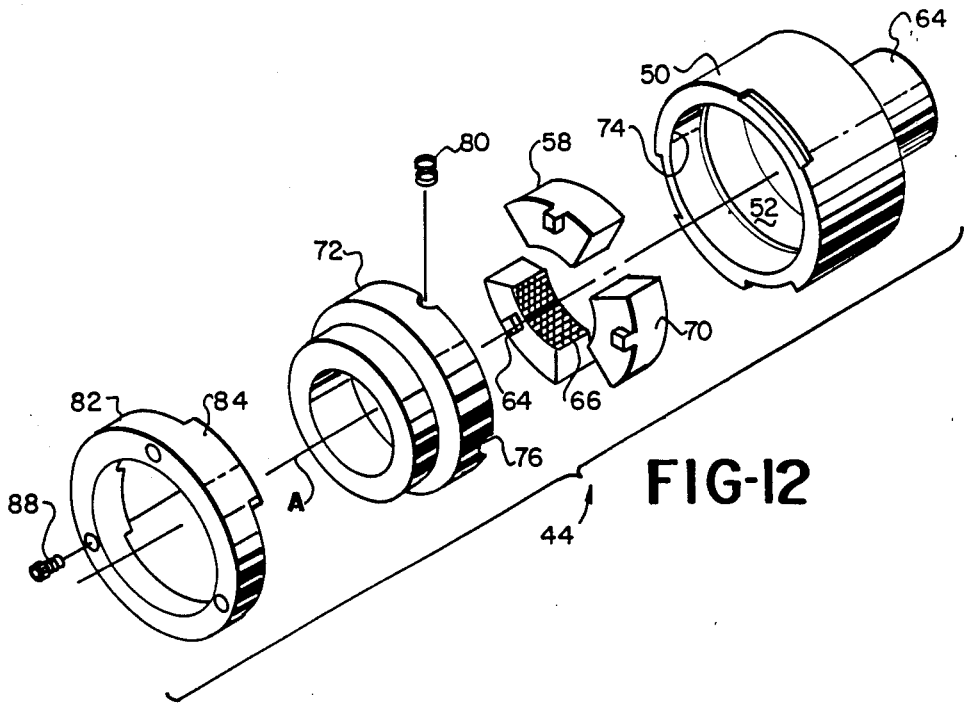
FIG. 12 is an exploded view of a gripping socket according to this invention.
Figure 13:
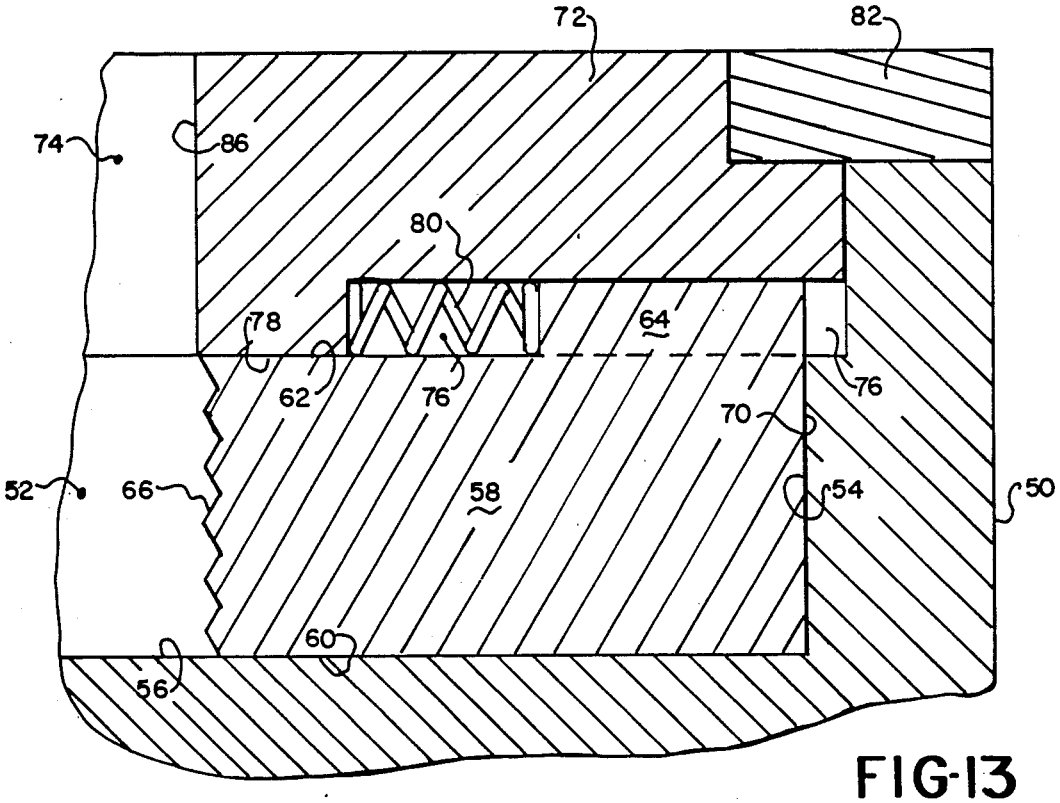
FIG. 13 is a detail of the gripping socket.

The shape of the jaws 58, more clearly seen from drawing FIGS. 4, 5, and 12, may be seen to be basically pie shaped. The small face is gripping face 66. This gripping face is a circular configuration so that it mates and has the same radius as an outside surface of coupling 68 so that it may readily grip the surface over an extended area of the surface and not depend upon a few small sharp contact areas which would tend to damage the surface of the coupling 68. Outer face or cam face 70 of the jaw mates with the housing cam 54. From the drawings and particularly from FIGS. 3, 4 and 5 it may seem that the jaws are flat jaws, i.e., the jaws have a flat top 62 except for lugs 64 and a flat bottom 60. The distance between the flat top and flat bottom will be a thickness. As particularly seen by the drawing, the width of the cam surface 70 is the same as the width of the gripping face 66 which is the same as the thickness of the jaw as particularly seen in FIG. 13. Thus it will be seen that none of the gripping faces extends above the flat top. The jaw cam surfaces 70 mate with more than half the housing cam surfaces 54 as clearly seen in FIGS. 4 and 5. Also it may be seen that the positioning ring extends from the cavity wall to the circular opening within an axial bore 86 of the positioning ring.

Positioning ring 72 fits within an upper circular cavity 74 immediately outward of the cam cavity 52. The positioning ring has a circular periphery so that it is readily rotatable about the axis "A" within the housing 50 of the gripping socket 44. The positioning ring has three elongated radial slots 76 in its lower surface 78. Lugs 64 of the jaws 58 slide within these slots. Compression spring 80 within the slots biases the lugs outward away from the axis "A". Therefore, without any other force upon the jaws, they will be moved outward by the compression springs 80. Since the lugs 64 themselves are elongated within the elongated slots 76, the positioning plate will hold the jaws 58 in proper orientation.

Retaining ring or holding ring 82 is bolted to the housing 50 along its perimeter. The retaining ring fits within the circular notch of the positioning ring (as shown) so that the retaining ring 82 holds the positioning ring 72 in place. The holes in which bolts 88 of the retaining ring fit are counter sunk so that the bolts will not project outward to cause a hazard to the operator as discussed above.

Between the housing 50 and the retaining ring 82, there are keys 84 set in slots to hold the retaining ring securely in place. These keys 84 have been shown in the drawings as peripheral projections from the retaining ring set notches in the housing 50. The purpose of the keys 84 are to hold the retaining ring 82 in angular position with respect to the housing 50. Experience has shown that the impact from the wrench together with the rotation of the housing results in undue strain upon the bolts 88. Other type keys could be used, i.e., ordinary keys could be made from square key stock and placed in square or rectangular radial slots cut into end face of housing 50 and the bottom face of retainer ring 82. The preferred form would be a matter of manufacturing costs.

The positioning ring 72 has an axial bore 86 therethrough which is larger than the coupling 68 to be broken. Also, the gripping faces 66 of the three jaws 58 will be circular, the diameter of which when the jaws are in the withdrawn position (FIG. 4), will be larger than the outside diameter of the coupling 68. Therefore, the gripping socket 44 can be telescoped over the coupling to be broken or removed from the sucker rod joint. When the impact wrench 36 is actuated, the housing 50 will rotate. Because of inertia, the jaws 58 and the positioning ring 72 will tend not to rotate; and therefore, the jaws will be closed by the cam surfaces 54 and 70. This will bring the gripping faces 66 in contact with the coupling 68. When the friction between faces 66 and coupling 68 will further prevent the jaws from rotating, which will further move the jaws inward by the action of the cam surfaces. The jaws 58 will continue to move inward until they securely grip the coupling face. It has been determined that they will indent themselves 0.001" or 0.002" into the coupling surface. At this point, the combined torque and impact produced by the impact wrench will cause rotation of the coupling.

Figure 7A:
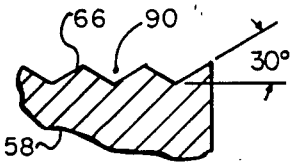
FIGS. 7 and 7-A are details of the gripping faces of the jaws.
Figure 7:
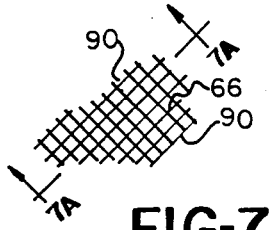

The gripping faces 66 of the jaws are scored to form a good grip by cutting intersecting "V" shaped grooves 90 therethrough (FIG. 7). These intersecting "V" grooves may either be on a square pattern or diamond pattern. If they were on the diamond pattern, basically this would form a knurled surface at the gripping face.

Figure 8:
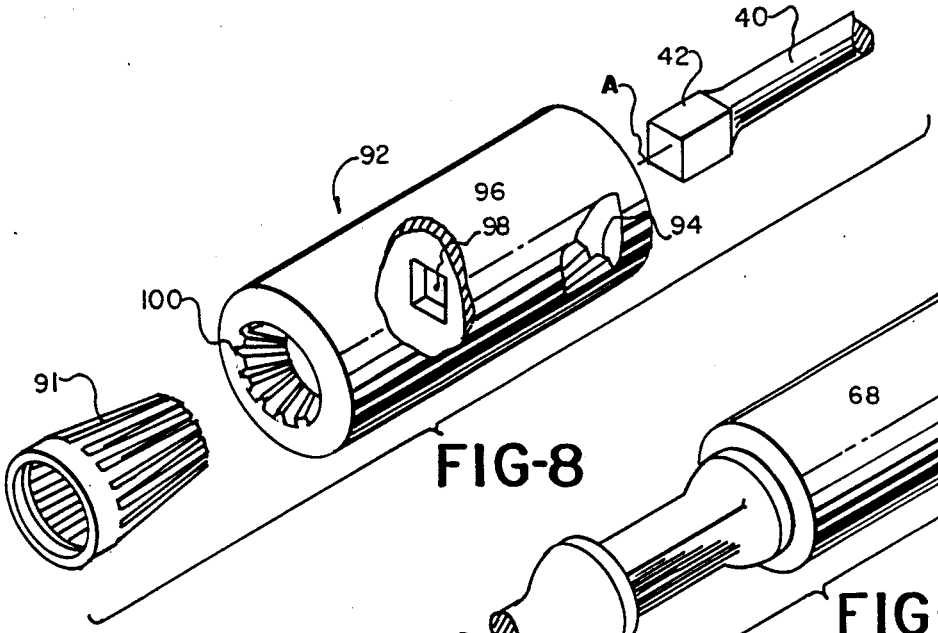
FIG. 8 is an expanded perspective view of a socket for protectors.
Figure 9:
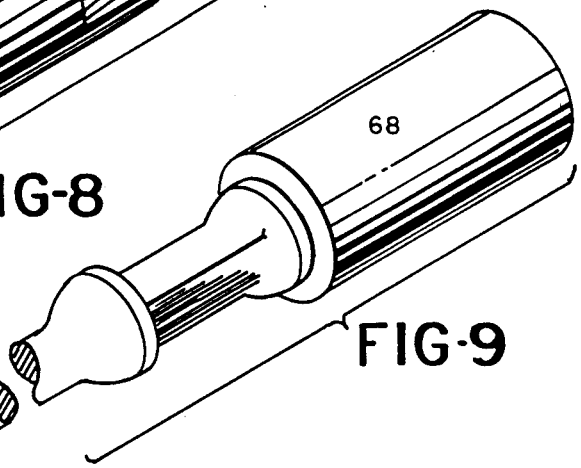
FIG. 9 is a perspective view of a pin of a sucker rod with a coupling thereon.
Figure 10:
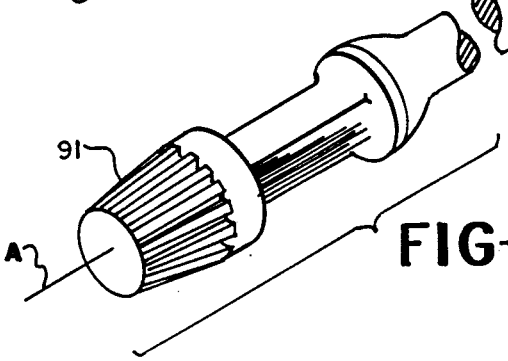
FIG. 10 is a perspective view of a pin of a sucker rod with a protector thereon.
Figure 11:
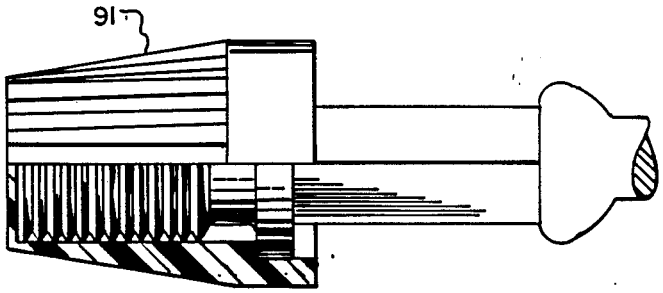
FIG. 11 is a half sectional view of a protector upon the pin of a sucker rod.

For use with the thread protectors 91, a double ended socket 92 as shown in FIG. 8 is used. One end will have a larger taper or conic bore 94 which is tapered inward from the outer ring The bore 94 will have grooves to match the spines on the thread protectors 91. The socket 92 will have an internal flange 96 about midpoint. The flange will have square hole 98 to match the square bit 42 of the anvil of the impact wrench 36. The other end of socket 92 will have a small conic bore 100. The two tapered sockets will be of different sizes to fit either large size or small size thread protector 91 with a certain amount of leeway so that the large end can fit two large sizes and the small end can fit two small sizes. If the socket 92 is to be used on a small size thread protector, the large bore 94 is telescoped over the extended anvil of the impact wrench.

Slot 102 through the housing 50 and the flat face 56 permits trash to fall from the housing.

Operation

A typical use of the equipment detailed above is that the sucker rod joint 26 would be pulled from the oil well 10. The single joint that was elevated by the elevator 30 would be disconnected by the power tongs from the string 14 which was still in the well. With the single joint removed and laid on the rack 28, the gripping socket 44 would be placed on the coupling 68 and the coupling removed therefrom by use of the impact wrench 36. Thereafter, the sucker rod pin would be cleaned, inspected, and lubricated.

Then a protector 91 would be placed in the double ended socket 92, and with the impact wrench 36, placed upon the pin. Then, the sucker rod 26 with the protected pins would be again elevated above the oil well 10 by the elevator 30 so that there was an upper pin and a lower pin. The double ended socket 92 would be used to remove the protector from the lower pin of the sucker rod, and then the lower pin would be threaded into a coupling which was upon the pin of the partial string 14 which was in the well.

Then, the joint would be torqued by the power tongs and the elevated joint would be lowered by the elevator 30 into the well. The string would be held by conventional slips. Then, the upper pin protector 91 would be removed by use of the double ended socket 92, and a coupling 68 would be hand threaded upon the upper pin.

With the procedures outlined above, it may be seen that it is possible to leave the protectors on until the last minute since they can be removed in a matter of seconds. By using the old method, the removal of the protectors took more time, and the operators would remove the protectors considerably in advance rather than use the precious time which the rods were suspended by the elevators above the well. It will be understood that the least amount of time that the protectors are removed, there is less possibility of the pins being contaminated by grit as contained by sand and dirt.

The embodiment shown and described above is only exemplary. I do not claim to have invented all the parts, elements or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. A gripping socket comprising:

a. a cupped shape housing having
   i. an axis,
   ii. an anvil end, and
   iii. an open end, b. said anvil end having a non-round hole therein adapted to receive the anvil of an impact wrench, c. said open end having a cavity therein, d. said cavity indicating three cam surfaces and a flat supporting face, e. three flat truncated pie shaped jaws in the cavity, each jaw having
   i. a cam surface mating with more than half a respective one of said cam surfaces of the housing,
   ii. a flat bottom slidingly supported by the supporting face,
   iii. a flat top face,
   iv. a thickness which is the distance from the flat bottom to the flat top face, and
   v. a scored gripping face of no greater width than the width of the cam surface 9 the jaw which is the same as the thickness of the flat jaw, f. a positioning ring rotatably mounted in the cavity above the flat jaws, ff. lug means attached to each of said top faces for engagement with said positioning ring, g. a retaining ring means bolted to the housing for retaining the positioning ring and permitting the positioning ring and the jaws to rotate about the axis of the housing.

2. The invention as defined in claim 1 further comprising:

h. an impact wrench having a non-round bit anvil inserted in said non-round hole.

3. The invention as defined in claim 1 further comprising:

h. wherein said lug means includes each jaw having a lug extending from the flat top face thereof, i. the positioning plate having three slots therein, j. said lug on the jaws positioned in a respective one of said slots, k. a compression spring in each of the slots biasing a respective one of said lugs, and thus the jaws outward away from the axis.

4. The invention as defined in claim 3 further comprising:

l. an impact wrench having a non-round bit anvil inserted in said non-round hole.

* * * * *